United States Patent [19]

Goetz

[11] Patent Number: 4,757,646

[45] Date of Patent: Jul. 19, 1988

[54] BOOM FOR WIRE COIL BLASTING APPARATUS

[75] Inventor: Ronald L. Goetz, Greencastle, Pa.

[73] Assignee: Pangborn Corporation, Hagerstown, Md.

[21] Appl. No.: 26,199

[22] Filed: Mar. 16, 1987

[51] Int. Cl.[4] ..... B24B 3/08

[52] U.S. Cl. ..... 51/410; 51/419

[58] Field of Search ..... 242/4 C, 18.1, 25 A, 242/26, 46, 118.41, 129, 82, 83; 51/410, 417, 419, 420, 426; 118/500, 325

[56] References Cited

U.S. PATENT DOCUMENTS

| | | | |
|---|---|---|---|
| 187,271 | 2/1877 | Haight | 242/129 |
| 259,214 | 6/1882 | Roberts | 242/129 |
| 3,298,631 | 1/1967 | Richardson | 242/129 |
| 3,481,080 | 12/1969 | Davidson | 51/420 |
| 4,349,165 | 9/1982 | Henning | 242/129 |
| 4,441,665 | 4/1984 | Hahm | 242/129 |
| 4,569,491 | 2/1986 | Kauffman | 242/118.41 |

*Primary Examiner*—Frederick R. Schmidt
*Assistant Examiner*—Blynn Shideler
*Attorney, Agent, or Firm*—Charles E. Brown

[57] ABSTRACT

A wire coil support in the form of a boom for a wire coil blasting apparatus wherein abrasives are thrown at or blasted at a coil wire carried by a wire support in the form of a boom. When the diameter of the wire in a given weight coil decreases, the number of coils in the coil greatly increases. As a result, the number of rows of coils increases and makes it more difficult to separate the individual coils for the reception of an abrasive blast. By modifying the boom to incorporate radial lifters, the coils may be separated, not only longitudinally, to provide for a more efficient abrasive blasting operation.

12 Claims, 2 Drawing Sheets

BOOM FOR WIRE COIL BLASTING APPARATUS

This invention relates in general to new and useful improvements in a wire coil blasting apparatus, and more particularly to an improved boom which is capable of separating the strands or coils of small diameter wire as well as strands or coils of much larger diameter wire.

I have developed a wire coil blasting apparatus which is the subject of my co-pending U.S. application for patent Ser. No. 736,223, filed May 20, 1985. In accordance with that application, a coil of wire is mounted on a rotating boom disposed within a chamber and abrasive material is directed to that coil of wire from a plurality of different angles by a plurality of throwing wheels. The apparatus which is specifically disclosed in my above-identified U.S. application has proven satisfactory in its operation. However, it has been recently found that when the diameter of the wire being cleansed is materially withdrawn so as to increase the length of the wire in a stock coil, insufficient separation of the individual strands or coils will be effected by the prior art boom to permit proper abrasive cleaning. For example, a three thousand pound coil of ¾ inch diameter wire has a length of 2173 feet and with coils having a diameter of 3 and ½ feet, there are 197 coils and divided over an 8 foot boom there will be 24.7 coils per foot. On the other hand, when the diameter of the wire is reduced to 5/16 inch, there will be 12,520 feet of such wire in a three thousand pound coil. This results in 1138 coils and when distributed over an 8 foot boom, there will be 142 coils per foot. Thus with the ¾ inch wire there will an average depth of 1.5 coils whereas with the 5/16 inch wire, there will be an average depth of 3.7 coils.

This invention particularly relates to modifying the prior art boom to effect a more complete separation of the coils with small diameter wire. In accordance with this invention, the boom is provided at intervals with radial lifters which separate adjacent coils in a radial or transverse direction in addition to the longitudinal direction provided by spacing the wire coil along the boom With the above and other objects in view that will hereinafter appear, the nature of the invention will be more clearly understood by reference to the following detailed description, the appended claims, and the several views illustrated in the accompanying drawings.

Figure 1:
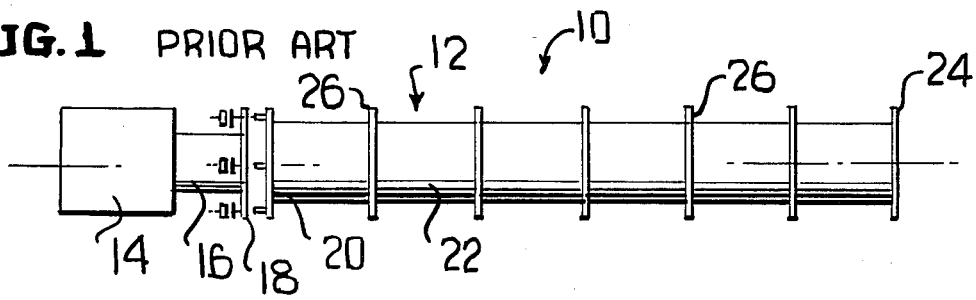
FIG. 1 PRIOR ART
FIG. 1 is a schematic elevational view of a prior art wire coil support in the form of a boom.
Figure 2:
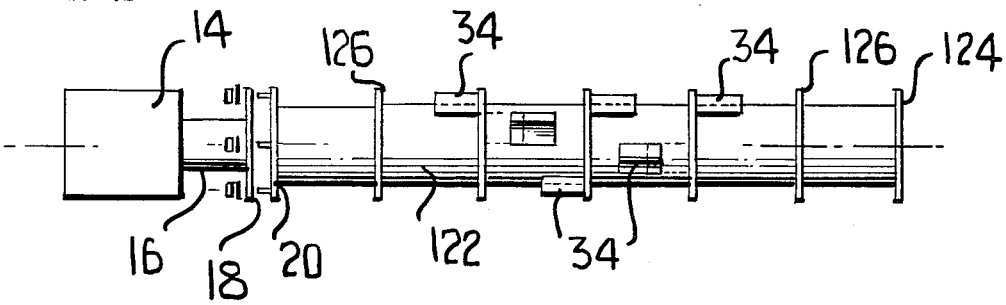
FIG. 2 is an elevational view similar to FIG. 1 showing an improved boom in accordance with this invention.

Referring now to the drawings in detail, reference is first made to FIG. 1 wherein there is illustrated a wire coil support for a wire coil blasting or abrasive cleaning apparatus, the support being generally identified by the numeral 10. The support 10 is in the form of a boom 12 which is normally horizontally disposed and mounted for rotation, first in one direction and then the opposite direction. Merely for illustrative purposes, there is illustrated a drive unit 14 having a stub shaft 16 carrying a flange 18. The boom 12 is illustrated as including a flange 20 which is secured to the flange 18.

The prior art boom 12 is in the form of an elongated shaft 22 having remote from the mounting flange 20 an end plate 24. Spaced along the shaft 22 is a plurality of annular plates 26 in the form of splitters.

In the utilization of the prior art boom 12, a coil of wire is generally stretched out over the length of the shaft 22 and then the boom with the wire coil thereon is placed in a compartment in which a number of throwing wheels direct blasts of abrasives against the wire of the wire coil.

The direction of rotation of the boom 12 was reversed so that the wire coil is fed first to the left and then back to the right without feeding off the free right end of the boom.

As described above, it has been found that when cleaning ½ inch to 1 inch diameter wire, the swinging action caused by the splitters 26 due to reversing rotation, and the action caused by the blasts of abrasives will open up sufficient gaps between the coils so that the blasts could impact either directly or by ricochet on all surfaces of the wire. However, it has been found that the boom 12, when utilized to clean smaller diameter wire, for example ¼ inch to 7/16 inch diameter wire, these actions have not been sufficient to open the coils to the abrasive blasts. The problem of cleaning smaller diameter wire has been solved in accordance with this invention by way of a modified wire coil support 30. The wire coil support 30, like the wire coil support 10, is in the form of a boom 32. The boom 32 replaces the boom 12 and includes a shaft 122 having at one end thereof a mounting flange 120 and at the opposite end thereof an end plate 124. Further, the shaft 122 has distributed along the length thereof annular plates in the form of splitters 126. The boom 32 is improved over the boom 12 in that it is further provided with radial lifters 34. In one form of the invention, the radial lifters 34 are between the splitters 126, but not between the mounting flange 120 and an associated splitter 126 or the end plate 124 and the associated splitter 126. This arrangement assures that the radial lifters 34 will not force the coils of a wire coil being cleansed over either the mounting flange 120 or the end plate 124.

Figure 3:
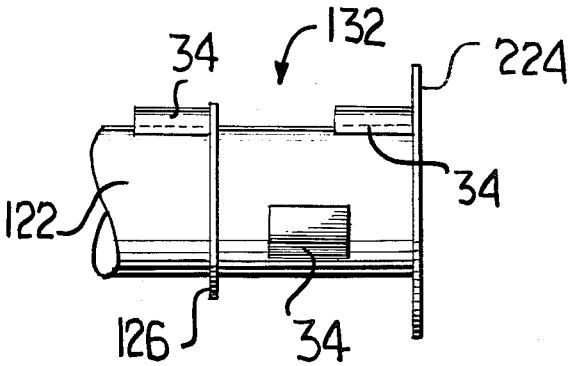
FIG. 3 is a fragmentary elevational view of the free end of a modified form of improved boom.

On the other hand, with reference to FIG. 3, a modified form of the boom 32, generally identified by the numeral 132 may be provided with lifters 34 between the outermost one of the splitters 126 and the end plate, the end plate being of a larger diameter than the end plate 124 and being identified by the numeral 224. The diameter of the end plate 224 will be sufficiently large so as to prevent the lifters 34 from directing the coils of the wire coil over it and off of the boom 132.

Figure 4:
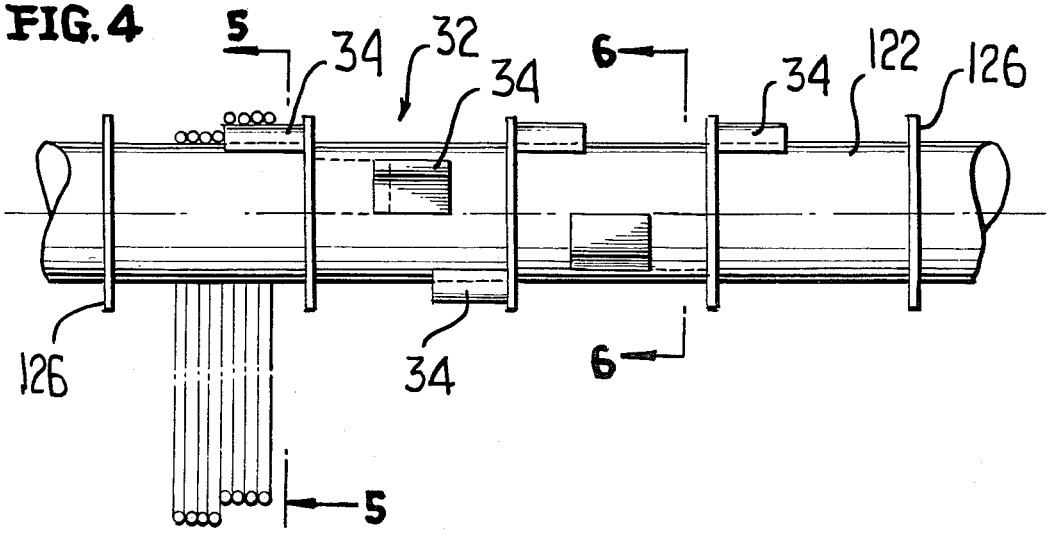
FIG. 4 is an enlarged fragmentary elevational view of a central portion only of the boom of FIG. 2.
Figure 5:
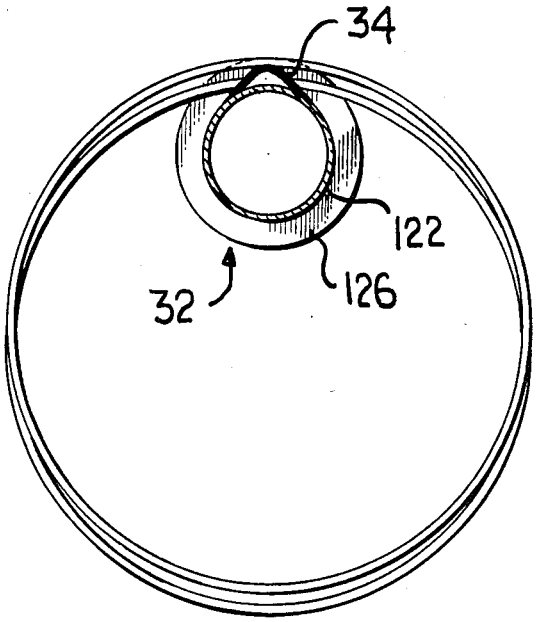
FIG. 5 is a transverse vertical sectional view taken generally along the line 5—5 of FIG. 4 and shows the arrangement of radial lifters carried by the shaft or the boom.
Figure 6:
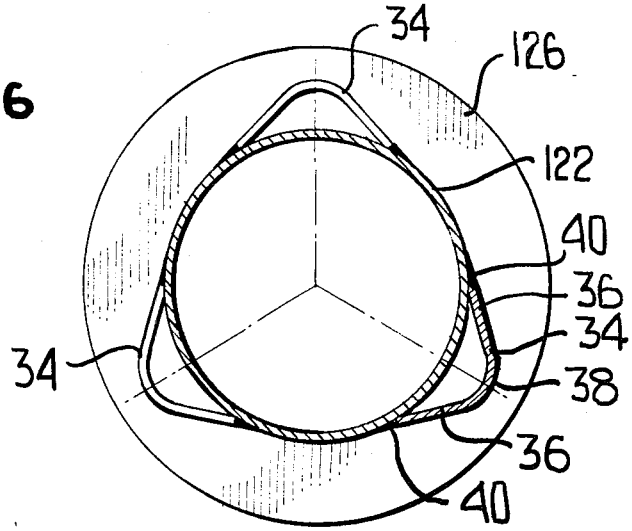
FIG. 6 is an enlarged fragmentary transverse sectional view taken generally along the line 6—6 of FIG. 4 and shows the specifics of a typical lifter and the manner in which it is secured to the boom shaft.

Reference is now made to FIGS. 4–6 wherein the details of the radial lifters 34 are illustrated. First of all, the radial lifters 34 are both longitudinally and circumferentially spaced. For example, between two adjacent splitters 126, there may be three of the radial lifters 34, the lifters 34 being angularly spaced 120°. It will also be seen that the radial lifters 34 will be of such longitudinal extent that a central one of the lifters 34 overlaps the other two.

Referring now to FIG. 6, it will be seen that a radial lifter 34 is in the form of an angle member having two legs 36 joined together by a bight 38. Each lifter 34 may be bent from sheet material if desired.

The free edges of the legs 36 abut the outer surface of the shaft 122 and are welded thereto by welds 40.

Referring once again to FIG. 4, it is to be noted that the remote lifters 34 of each set should abut against their respective splitters 126.

Referring once again to FIGS. 4 and 5, it will be seen that as the boom 32 rotates the wire coil positioned thereon is progressively engaged by the lifters 34 so that certain of adjacent coils or strands are engaged by a lifter and raised relative to coils supported directly by the shaft 122. Thus the coils have an up and down motion relative to one another so as to further separate the coils transversely in addition to longitudinally as in the case of the boom 12.

Figure 7A:
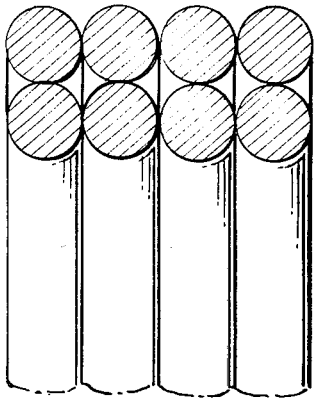
FIG. 7A is a transverse sectional view through a wire coil of large diameter wire.
Figure 7B:
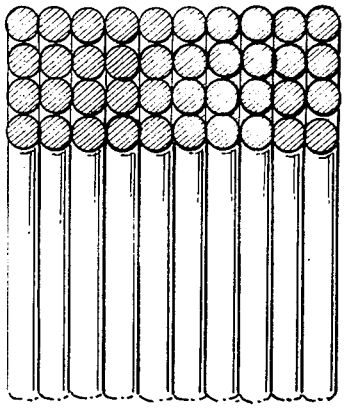
FIG. 7B is a comparative sectional view taken therethrough a coil of wire of a smaller diameter than the wire of FIG. 7A and shows the comparative number of coils.

FIGS. 7A and 7B are provided to illustrate the relative number of coils per unit boom length for ¾ inch diameter wire in FIG. 7A and 5/16 inch diameter wire in FIG. 7B. It is urged that the illustrations of FIGS. 7A and 7B clearly indicate why the additional coil action provided by the radial lifters 34 is required in the cleansing of small diameter wire.

Although only several preferred embodiments of the improved boom have been specifically illustrated and described herein, it is understood that minor variations may be made in the boom construction without departing from the spirit and scope of the invention as defined by the appended claims.

I claim:

1. A wire coil support comprising an elongated boom having means at one end for mounting said boom for rotation in an abrasive throwing chamber, said boom being in the form of an elongated shaft carrying in spaced longitudinal relation annular plates in the form of splitters for axially separating coil strands, said boom being improved by providing said shaft with radial lifters between at least certain of said splitters, said radial lifters forming means for radially separating coil strands by radially displacing separate sets of coil strands.

2. A wire coil support according to claim 1 wherein said radial lifters are arranged in a set between adjacent ones of said splitters.

3. A wire coil support according to claim 2 wherein said radial lifters of a set are arranged in longitudinally spaced relation.

4. A wire coil support according to claim 2 wherein said radial lifters of a set are arranged in circumferentially spaced relation.

5. A wire coil support according to claim 4 wherein said radial lifters of said set are longitudinally overlapped.

6. A wire coil support according to claim 2 wherein said radial lifters of a set are arranged in longitudinally and circumferentially spaced relation with two of said radial lifters of said set abutting one each of said adjacent ones of said splitters, and each set of radial lifters including at least a third radial lifter longitudinally spaced from each of said splitters.

7. A wire coil support according to claim 2 wherein said radial lifters of a set are arranged in longitudinally and circumferentially spaced relation.

8. A wire coil support according to claim 7 wherein said radial lifters of said set are longitudinally overlapped.

9. A wire coil support according to claim 1 wherein said radial lifters are positioned primarily in a longitudinally central portion of said boom.

10. A wire coil support according to claim 1 wherein the opposite end of said boom is free, said radial lifters extend in that portion of said shaft adjacent said boom opposite end, and said boom opposite end has an enlarged plate for preventing a wire coil from moving off said boom free end.

11. A wire coil support according to claim 1 wherein each of said lifters is in the form of an angle member opening towards said shaft and having a radially outwardly directed apex.

12. A wire coil support according to claim 11 wherein each of said lifters has remote edges directly welded to said shaft.

* * * * *